US012392499B2

(12) United States Patent
Chimurkar et al.

(10) Patent No.: US 12,392,499 B2
(45) Date of Patent: Aug. 19, 2025

(54) OVEN APPLIANCE HAVING ONE OR MORE COOLING AIRFLOW FEATURES

(71) Applicant: Haier US Appliance Solutions, Inc., Wilmington, DE (US)

(72) Inventors: Ishan Prakashrao Chimurkar, Layfayette, GA (US); Frank Jacob Hellwig, East Ridge, TN (US); Willie D. Warren, Jr., Ringgold, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 560 days.

(21) Appl. No.: 17/724,673

(22) Filed: Apr. 20, 2022

(65) Prior Publication Data

US 2023/0341132 A1 Oct. 26, 2023

(51) Int. Cl.
*F24C 15/00* (2006.01)
*F24C 15/12* (2006.01)

(52) U.S. Cl.
CPC ..... *F24C 15/006* (2013.01); *F24C 15/12* (2013.01)

(58) Field of Classification Search
CPC ..... F24C 15/006; F24C 15/12; F24C 15/08
USPC ..... 126/21 R
See application file for complete search history.

(56) References Cited

U.S. PATENT DOCUMENTS

| | | | | |
|---|---|---|---|---|
| 7,954,485 | B2 | 6/2011 | Cadima et al. | |
| 2006/0151492 | A1* | 7/2006 | Bray | A47J 36/027 219/756 |
| 2015/0075513 | A1* | 3/2015 | Paller | F24C 15/006 126/198 |
| 2017/0292713 | A1* | 10/2017 | Boedicker | F24C 15/006 |
| 2020/0408419 | A1* | 12/2020 | Diehl | F24C 15/101 |
| 2021/0207812 | A1* | 7/2021 | Bhogal | F24C 15/006 |
| 2021/0388995 | A1* | 12/2021 | Dulak | F24C 15/322 |

FOREIGN PATENT DOCUMENTS

| | | | | |
|---|---|---|---|---|
| CN | 203671679 | U | 6/2014 | |
| CN | 208176498 | U | 12/2018 | |
| KR | 100214627 | B1 | 8/1999 | |
| KR | 100693147 | B1 | 3/2007 | |
| KR | 20180119743 | A * | 11/2018 | F28D 1/0226 |

OTHER PUBLICATIONS

Korean to English machine translation of KR20180119743A.*
Korean to English machine translation of KR20180119743A (Year: 2018).*

* cited by examiner

*Primary Examiner* — Michael G Hoang
*Assistant Examiner* — Elizabeth Ann Laughlin
(74) *Attorney, Agent, or Firm* — Dority & Manning, P.A.

(57) ABSTRACT

An oven appliance may include a cabinet, an insulated cooking chamber, and a plurality of internal ridge. The cabinet may include a plurality of outer panels. The cabinet may define an airflow path extending through the cabinet. The insulated cooking chamber may be disposed within the cabinet. The airflow path may be defined between the outer panels and the insulated cooking chamber. The plurality of internal ridges may be disposed within the cabinet. The plurality of internal ridges may extend along the airflow path and define a guided segment thereof. The plurality of internal ridges may be spaced apart along the airflow path and thereby define a cross-path gap between adjacent ridges of the plurality of internal ridges.

20 Claims, 7 Drawing Sheets

OVEN APPLIANCE HAVING ONE OR MORE COOLING AIRFLOW FEATURES

FIELD OF THE INVENTION

The present disclosure relates generally to an oven appliance, or more specifically, to an oven appliance having one or more features to ensure cooling of an outer surface.

BACKGROUND OF THE INVENTION

Oven appliances generally define one or more enclosures supporting one or more heating elements. For instance, oven appliances can include a cabinet defining an insulated cooking chamber therein for receipt of food items for cooking. Heating elements, such as a bake heating element or broil heating element may be positioned within the cooking chamber to provide heat to food items located therein. The bake heating element is positioned at a bottom of the cooking chamber. The broil heating element positioned at a top of the cooking chamber. One or more electronic components may be housed within the cabinet outside of the cooking chamber.

In general, it can be desirable to manage heat or temperatures at outer surface of the cabinet or enclosure. Recently, certain government or trade group standards having even incorporated requirements that accessible portions of an oven cabinet being maintained below one or more temperature thresholds during use. One such requirement is included in the updated UL858 standard (as is intended to take effect in November 2022), which adopts temperature thresholds for the increase in temperature for surfaces below 31 inches of installation height from the floor during a 475° Fahrenheit (i.e., 246° Celsius) oven bake operation for the surfaces that are accessible by a specified access probe—such surfaces may be required to be measured by an International Electrotechnical Commission (IEC)-compliant temperature probe. For instance, a temperature threshold for bare or painted metal is 33° Celsius, hence the metal may be required to stay at or below is 58° Celsius in a 25° Celsius ambient environment.

Existing appliances may have difficulties meeting the updated standards or otherwise cooling the cabinet. For instance, it may be difficult to ensure a sufficient cooling airflow is available throughout the airflow path for cooling air within certain portions of the cabinet (e.g., without requiring larger or more numerous fans, which can complicate assembly and increase expenses).

As a result, it would be useful to provide an oven appliance with one or more features to cool an outer surface (e.g., accessible by a standardized probe) of the oven appliance. In particular, it may be advantageous to include one or more features to disperse or more evenly distribute a cooling airflow through the cabinet of an oven appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, an insulated cooking chamber, and a plurality of internal ridge. The cabinet may include a plurality of outer panels. The cabinet may define an airflow path extending through the cabinet. The insulated cooking chamber may be disposed within the cabinet. The airflow path may be defined between the outer panels and the insulated cooking chamber. The plurality of internal ridges may be disposed within the cabinet. The plurality of internal ridges may extend along the airflow path and define a guided segment thereof. The plurality of internal ridges may be spaced apart along the airflow path and thereby define a cross-path gap between adjacent ridges of the plurality of internal ridges.

In another exemplary aspect of the present disclosure, an oven appliance is provided. The oven appliance may include a cabinet, an insulated cooking chamber, and a plurality of internal ridges. The cabinet may include a plurality of outer panels including a top panel, a rear panel, and a bottom panel. The cabinet may define an airflow path extending through the cabinet. The insulated cooking chamber may be disposed within the cabinet. The airflow path may be defined between the outer panels and the insulated cooking chamber. The plurality of internal ridges may be formed on the bottom panel within the cabinet. The plurality of internal ridges may extend along the airflow path and define a guided segment thereof. The plurality of internal ridges may be spaced apart along a transverse direction and thereby define a lateral cross-path gap between adjacent ridges of the plurality of internal ridges.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
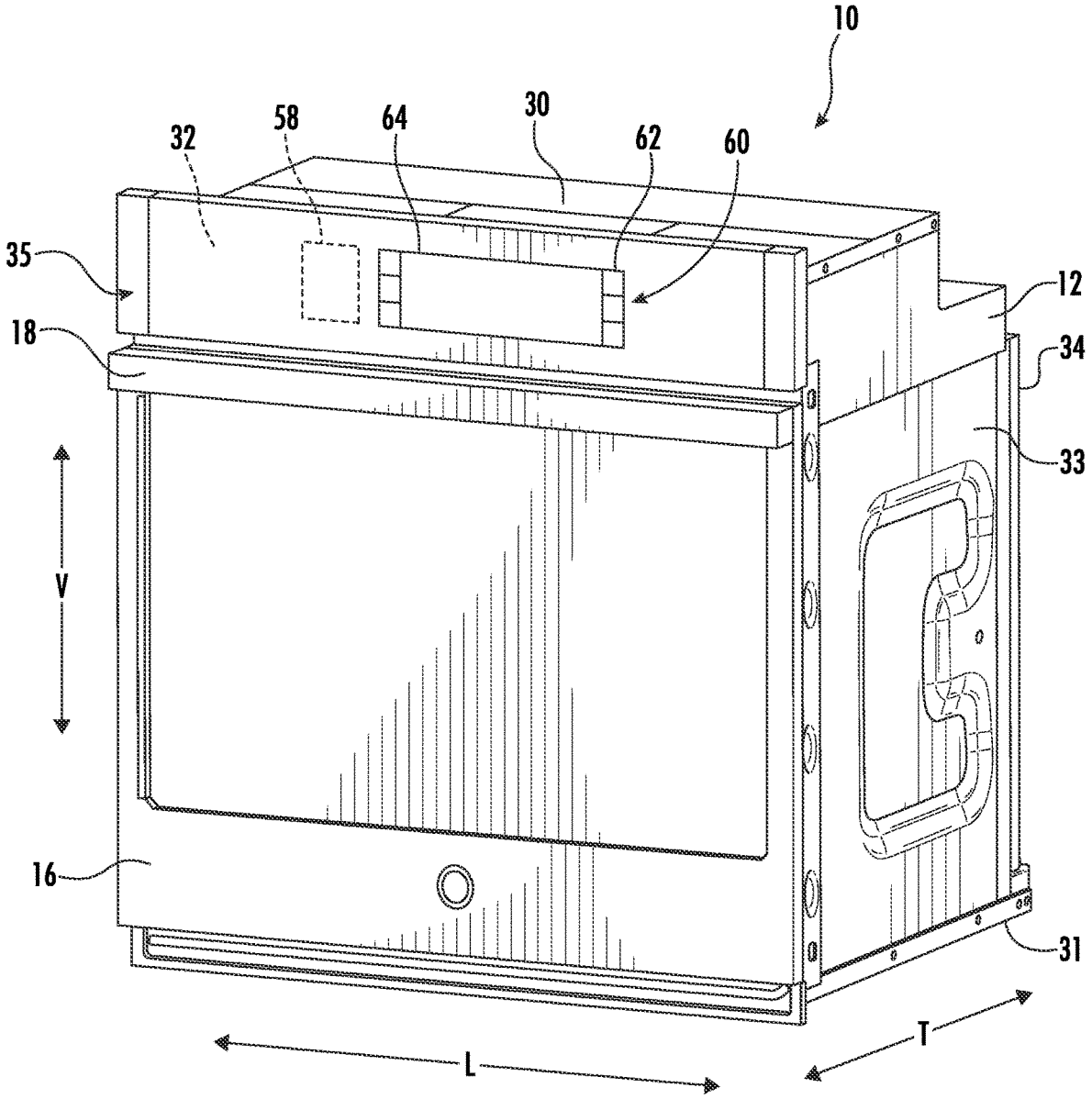
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
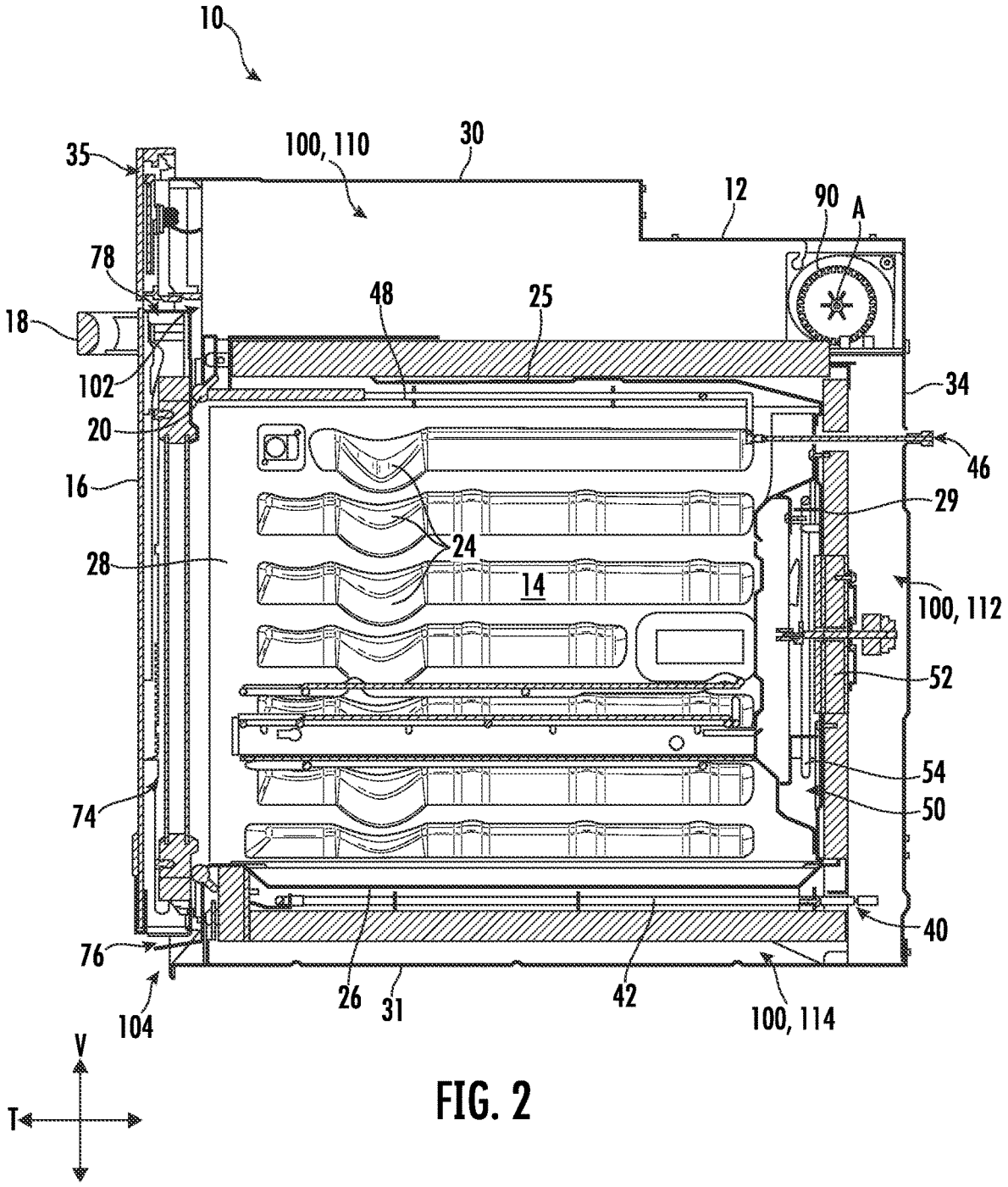
FIG. 2 provides a section view of the exemplary oven appliance of FIG. 1, taken along the lines 2-2.

FIGS. 1 and 2 depict an exemplary oven appliance 10 that may be configured in accordance with aspects of the present disclosure. FIG. 1 provides a perspective view of oven appliance 10 according to an exemplary embodiment of the present disclosure. FIG. 2 provides a cross sectional view of oven appliance 10 taken along the 2-2 line of FIG. 1. For the particular embodiment of FIGS. 1 and 2, oven appliance 10 defines a vertical direction V, a lateral direction L and a transverse direction T. The vertical, lateral and transverse directions are mutually perpendicular and form an orthogonal direction system. As will be understood by those skilled in the art, oven appliance 10 is provided by way of example only, and the present subject matter may be used in any suitable oven appliance. Thus, the present subject matter may be used with other oven appliances having different configurations.

Oven appliance 10 includes a cabinet 12 with an insulated cooking chamber 14 disposed within cabinet 12. Insulated cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access insulated cooking chamber 14. For example, a user can pull on handle 18 to open or close door 16 and access insulated cooking chamber 14.

Various chamber walls define insulated cooking chamber 14. For example, insulated cooking chamber 14 includes a top wall 25 and a bottom wall 26 which are spaced apart along the vertical direction V. A pair of sidewalls 28 extend between the top wall 25 and bottom wall 26, and are spaced apart along the lateral direction L. A rear wall 29 may additionally extend between the top wall 25 and bottom wall 26 as well as between the pair of sidewalls 28, and is spaced apart from door 16 along the transverse direction T. In this manner, when door 16 is in the closed position, a cooking cavity is defined by door 16 and top wall 25, bottom wall 26, sidewalls 28, and rear wall 29, of insulated cooking chamber 14.

According to the illustrated embodiment, the chamber walls of insulated cooking chamber 14 are depicted as simple blocks of insulating material surrounding the cooking cavity. However, one skilled in the art will appreciate that the insulating material may be constructed of one or more suitable materials and may take any suitable shape. For example, the insulating material may be encased in one or more rigid structural members, such as sheet metal panels, which provide structural rigidity and a mounting surface for attaching, for example, heating elements, temperature probes, rack sliding assemblies, and other mechanical or electronic components.

Cabinet 12 includes multiple outer panels that enclose insulated cooking chamber 14. For example, cabinet 12 includes a top panel 30 and a bottom panel 31 which are spaced apart along the vertical direction V. Left panel 32 and right panel 33 (as defined according to the view as shown in FIG. 1) extend between the top panel 30 and bottom panel 31, and are spaced apart along the lateral direction L. A rear panel 34 may additionally extend between the top panel 30 and bottom panel 31 as well as between the left panel 32 and right panel 33, and is spaced apart from door 16 along the transverse direction T. When door 16 is in the closed position, it may sit flush with a front panel 35 of cabinet 12.

According to the illustrated embodiment, the panels of cabinet 12 are single ply sheet metal panels, but one skilled in the art will appreciate that one or more of the panels may include other suitably rigid panels while remaining within the scope of the present subject matter. For example, according to an exemplary embodiment, one or more panels may be constructed from a suitably rigid and thermally resistant plastic. In addition, one or more panels may include multiple layers made from the same or different materials, and may be formed in any suitable shape.

In some embodiments, a lower heating assembly, e.g., bake heating assembly 40, is included in oven appliance 10, and may include one or more heating elements, e.g. bake heating elements 42. Bake heating elements 42 may be disposed within insulated cooking chamber 14, such as adjacent bottom wall 26. In exemplary embodiments as illustrated, the bake heating elements 42 are electric heating elements, as is generally understood. Alternatively, the bake heating elements 42 may be gas burners or other suitable heating elements having other suitable heating sources. Bake heating elements 42 may generally be used to heat insulated cooking chamber 14 for both cooking and cleaning of oven appliance 10.

In additional or alternative embodiments, an upper heating assembly, e.g., broil heating assembly 46, is included in oven appliance 10, and may include one or more upper heating elements, e.g., broil heating elements 48. Broil heating elements 48 may be disposed within insulated cooking chamber 14, such as adjacent top wall 25. In exemplary embodiments as illustrated, the broil heating elements 48 are electric heating elements, as is generally understood. Alternatively, the broil heating elements 48 may be gas burners or other suitable heating elements having other suitable heating sources. Broil heating elements 48 may additionally generally be used to heat insulated cooking chamber 14 for both cooking and cleaning of oven appliance 10.

In optional embodiments, oven appliance 10 includes a convection heating assembly 50. Convection heating assembly 50 may have a fan 52 and a convection heating element 54. Convection heating assembly 50 is configured for selectively urging a flow of heated air into insulated cooking chamber 14. For example, fan 52 can pull air from insulated cooking chamber 14 into convection heating assembly 50 and convection heating element 54 can heat such air. Subsequently, fan 52 can urge such heated air back into insulated cooking chamber 14. As another example, fan 52 can cycle heated air from insulated cooking chamber 14 within insulated cooking chamber 14 in order to generate forced convective air currents without use of convection heating element 54. Like heating elements 42, 48 discussed above, convection heating element 54 may be, for example, a gas, electric, or microwave heating element or any suitable combination thereof. According to an alternative exemplary embodiment, convection heating assembly 50 need not include fan 52.

Oven appliance 10 is further equipped with a controller 58 to regulate operation of the oven appliance 10. For example, controller 58 may regulate the operation of oven appliance 10 including heating elements 42, 48, 54 (and heating assemblies 40, 46, 50 generally). Controller 58 may be in communication (via for example a suitable wired or wireless connection) with the heating elements 42, 48, 54 and other suitable components of the oven appliance 10, as discussed herein. In general, controller 58 may be operable to configure the oven appliance 10 (and various components thereof) for cooking. Such configuration may be based on a plurality of cooking factors of a selected operating cycles, sensor feedback, etc.

By way of example, controller 58 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 58 may be positioned in a variety of locations throughout oven appliance 10. In the illustrated embodiment, controller 58 may be located within a user interface panel 60 of oven appliance 10 as shown in FIG. 1. In such an embodiment, input/output ("I/O") signals may be routed between the control system and various operational components of oven appliance 10 along wiring harnesses that may be routed through cabinet 12. Typically, controller 58 is in communication with user interface panel 60 and controls 62 through which a user may select various operational features and modes and monitor progress of oven appliance 10. In one embodiment, user interface panel 60 may represent a general purpose I/O ("GPIO") device or functional block. In one embodiment, user interface panel 60 may include input components or controls 62, such as one or more of a variety of electrical, mechanical or electro-mechanical input devices including rotary dials, push buttons, and touch pads. User interface panel 60 may include a display component, such as a digital or analog display device 64 designed to provide operational feedback to a user.

User interface panel 60 may be in communication with controller 58 via one or more signal lines or shared communication busses. Controller 58 may also be communication with one or more sensors, e.g., a temperature sensor that is used to measure temperature inside insulated cooking chamber 14 and provide such measurements to controller 58. The temperature sensor may be a thermocouple, a thermistor, a resistance temperature detector, or any other device suitable for measuring the temperature within insulated cooking chamber 14. In this manner, controller 58 may selectively control heating elements 42, 48, 54 in response to user manipulation of user interface panel 60 and temperature feedback from the temperature sensor. Controller 58 can also receive temperature measurements from the temperature sensor placed within insulated cooking chamber 14 and e.g., provide a temperature indication to the user with display 64.

It should be appreciated that the invention is not limited to any particular style, model, or configuration of oven appliance 10. The exemplary embodiment depicted in the figures is for illustrative purposes only. For example, except as otherwise indicated, different locations may be provided for user interface panel 60, different configurations may be provided for the baking rack or ribs 24, different cooling air flow paths may be utilized, and other differences may be applied as well.

Figure 3:
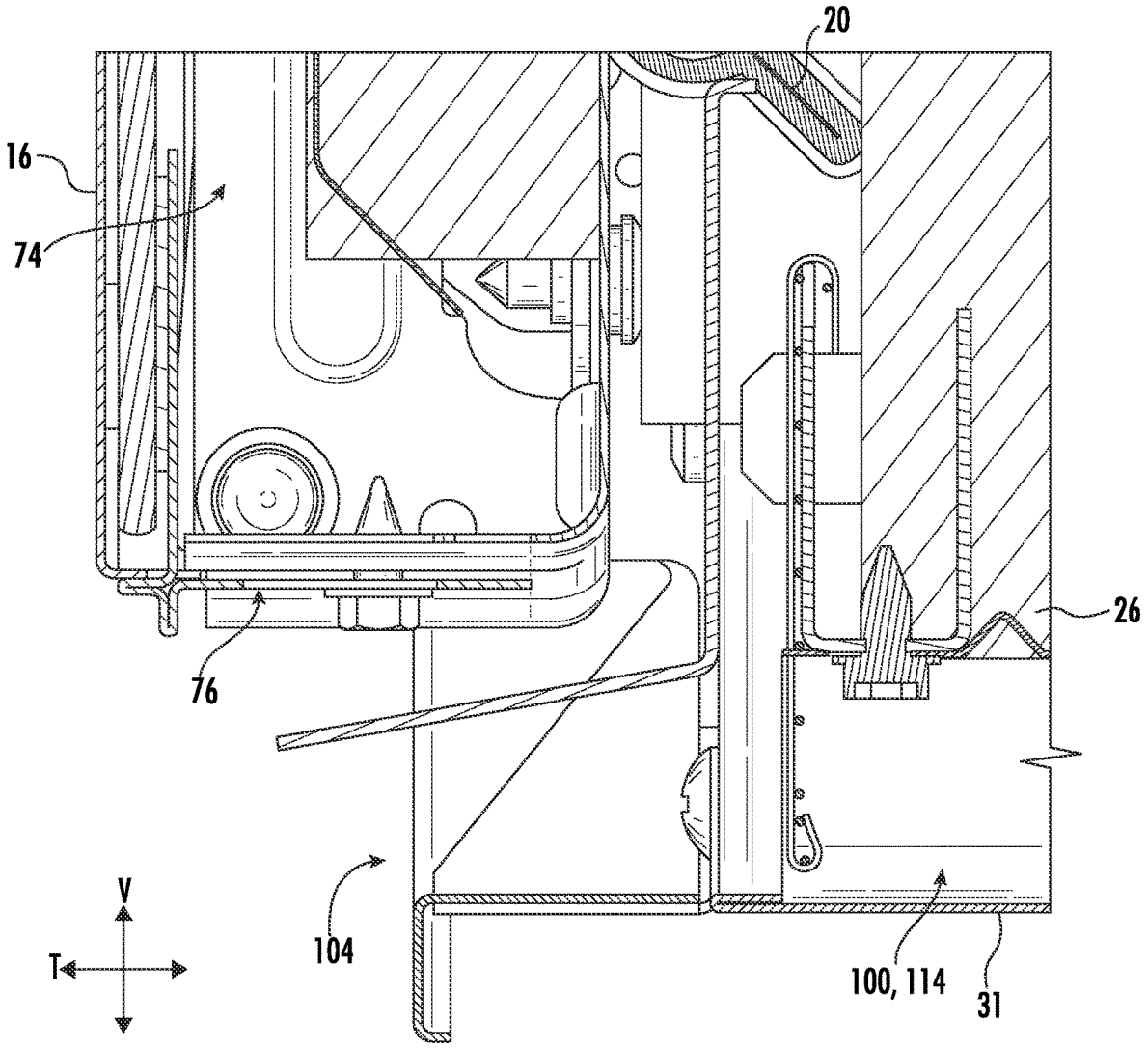
FIG. 3 provides a magnified section view of a bottom portion of the exemplary oven appliance of FIG. 1.
Figure 4:
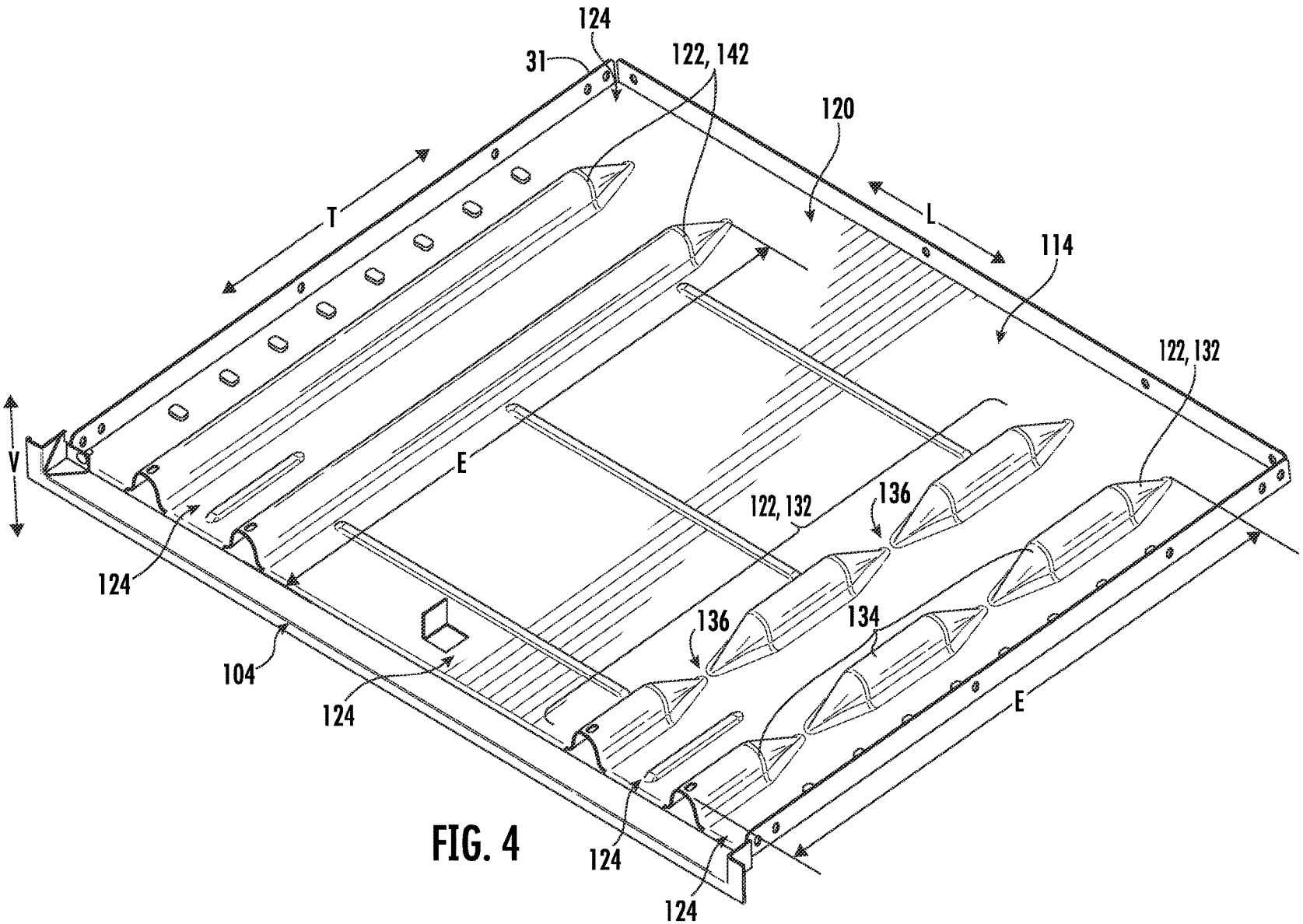
FIG. 4 provides a perspective view of a bottom panel of a cabinet of an oven appliance according to exemplary embodiments of the present disclosure.

Turning especially to FIGS. 2 and 3, in some embodiments, door 16 defines an intake 76, an internal conduit or channel 74, and an exhaust 78. In some embodiments, intake 76 of door 16 is positioned at or adjacent bottom lip of door 16 and permits air therethrough. Conversely, exhaust 78 of door 16 is positioned at or adjacent top lip of door 16. Channel 74 extends between intake 76 of door 16 and exhaust 78 of door 16 (e.g., such that intake 76 and exhaust 78 are in fluid communication with each other when door 16 is in the closed position). During use, channel 74 permits the flow of air to flow through door 16 from intake 76 to exhaust 78. Exhaust 78 may be located at top surface of the door 16, a front surface of door 16, or a combination thereof.

The flow of air through door 16 can assist with limiting or reducing heat transfer along the transverse direction T (e.g., during operation of bottom or top heating elements 42 and 48 of oven range appliance 10). As an example, an inner surface of door 16 faces and is positioned adjacent cooking chamber 14 of cabinet 12 when door 16 is in the closed position. Conversely, an outer surface of door 16 is positioned opposite inner surface of door 16 and faces away from cooking chamber 14 of cabinet 12 when door 16 is in the closed position. The flow of air can be cool relative to the inner surface of door 16 such that the flow of air limits or reduces heat transfer between the inner surface of door 16 and the outer surface of door 16 during operation of bottom or top heating elements 48 and 42 of oven range appliance 10 (e.g., such that the outer surface of door 16 is cool relative to the inner surface of door 16). In such a manner, the outer surface of door 16 can be insulated.

Separate from or in addition to the internal channel 74 of door 16, the cabinet 12 may generally define an airflow path 100 that extends (e.g., continuously) through the cabinet 12. During use, the airflow path 100 may direct a cooling airflow through the cabinet 12 and about the cooking chamber 14 (e.g., to reduce the temperature of the outer panels or otherwise reduce the transmission of heat from the walls of the cooking chamber 14 to the outer panels). In the illustrated embodiment, the airflow path 100 extends within the cabinet 12 from an upper air intake 102 to a lower air exhaust 104. As shown, air intake 102 may be defined at an upper portion of the front end of cabinet 12 (e.g., above door 16). Air exhaust 104 may be defined at a lower portion of the front end (e.g., below door 16).

The outer panels may serve to define (e.g., at least in part) one or more segments of the airflow path 100. For instance, airflow path 100 may be at least partially defined by the open region or gap provided between an outer panel and a wall of cooking chamber 14. A top segment 110 may be defined between the top panel 30 and the insulated cooking chamber 14 (e.g., at top wall 25). The top segment 110 may extend along the transverse direction T (e.g., from the front to the rear of cabinet 12) while spanning a lateral portion of the cabinet 12 (e.g., between the left and right panels). A rear segment 112 may be defined downstream from the top segment 110 between the rear panel 34 and the insulated cooking chamber 14 (e.g., at rear wall 29). The rear segment 112 may extend along the vertical direction V (e.g., from the top to the bottom of cabinet 12) while spanning a lateral portion of the cabinet 12 (e.g., between the left and right panels). A bottom segment 114 may be defined downstream from the rear segment 112 between the bottom panel 31 and the insulated cooking chamber 14 (e.g., at bottom wall 26 2). The bottom segment 114 may extend along the transverse direction T (e.g., from the rear to the front of cabinet 12) while spanning a lateral portion of the cabinet 12 (e.g., between the left and right panels 32, 33).

Although the airflow path 100 is defined between an internal surface 120 of outer panels and an exterior surface of the walls of cooking chamber 14, it is noted that one or more intermediate elements (e.g., on or surrounding the exterior surface of cooking chamber 14) may serve to further limit or define the airflow path 100.

A fan 90 is mounted within the cabinet 12 along the airflow path 100 and is configured for motivating air therethrough. According to the illustrated embodiment, fan 90 is a tangential fan that is positioned toward a back end of duct 130 proximate rear panel 34 of cabinet 12. In particular, fan 90 is mounted such that a rotation axis A of fan 90 is disposed above (e.g., at a higher position relative to the vertical direction V). In the pictured embodiments, fan 90 is mounted on the left side of cabinet 12. Alternatively, though, fan 90 could be mounted on the right side or at the center of cabinet 12. Moreover, one skilled in the art will appreciate that any other suitable fan type, position, configuration, or number may be used while remaining within the scope of the present subject matter. For example, fan could instead be a radial fan positioned toward a front end of airflow path 100. Additionally or alternatively, multiple fans may be provided (e.g., parallel tangential fans space apart along the lateral direction L).

Turning now generally to FIGS. 4 through 8, various perspective views are provided of an outer panel of cabinet 12, which forms a portion of the airflow path 100 (e.g., bottom segment 114—FIG. 2). In particular, an exemplary bottom panel 31 is shown. As such, bottom panel 31 may be included with or provided as the bottom panel 31 shown in FIGS. 1 through 3. During use, air may thus flow across the internal surface 120 of bottom panel 31 (as indicated by arrows 118—FIG. 5). Notably, bottom panel 31 allows for a generally even or balanced airflow spread across the lateral width of panel 31 (e.g., regardless of where fan 90 is mounted) and may cool front lower exterior surfaces.

As shown, multiple guide ridges 122 may be provided along airflow path 100 to help direct air toward the air exhaust 104. In some embodiments, guide ridges 122 may further support the weight of the appliance 10. Together, the guide ridges 122 may form discrete sub-channels or guided segments 124 of airflow path 100. For instance, in the illustrated embodiments, multiple guide ridges 122 extend along a length of the airflow path 100 (e.g., parallel to the transverse direction T). Each guide ridge 122 thus defines a length E along the airflow path 100 (e.g., parallel to the transverse direction T). In some embodiments, one or more guide ridges 122 are transversely spaced apart from a rear end of the bottom panel 31 (e.g., to form a space or gap between a proximal tip of guide ridge 122 and the rear end). In additional or alternative embodiments, one or more guide ridges 122 terminates at a front end of the bottom panel 31.

Figure 6:
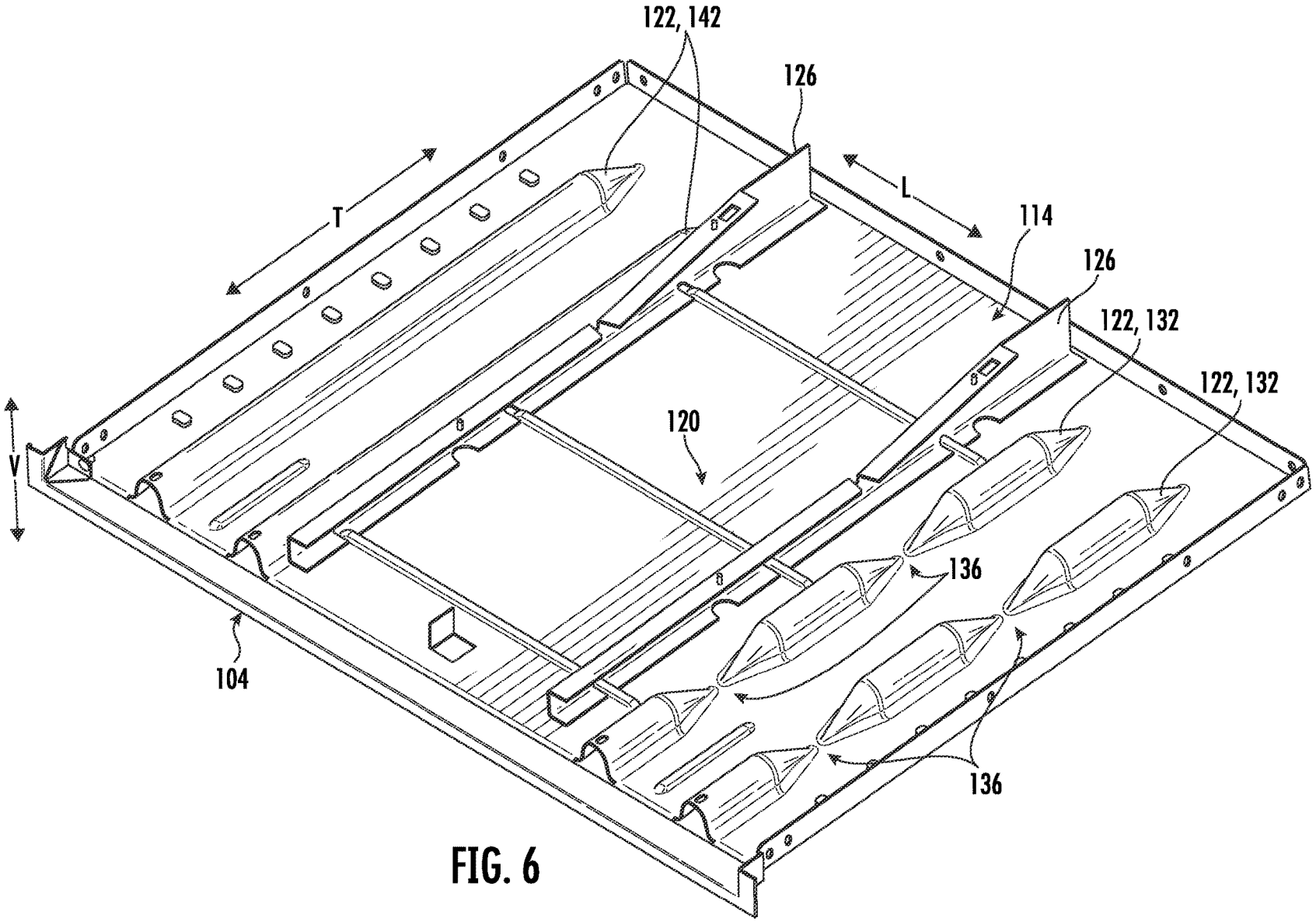
FIG. 6 provides a perspective view of a bottom panel of a cabinet of an oven appliance according to other exemplary embodiments of the present disclosure.
Figure 7:
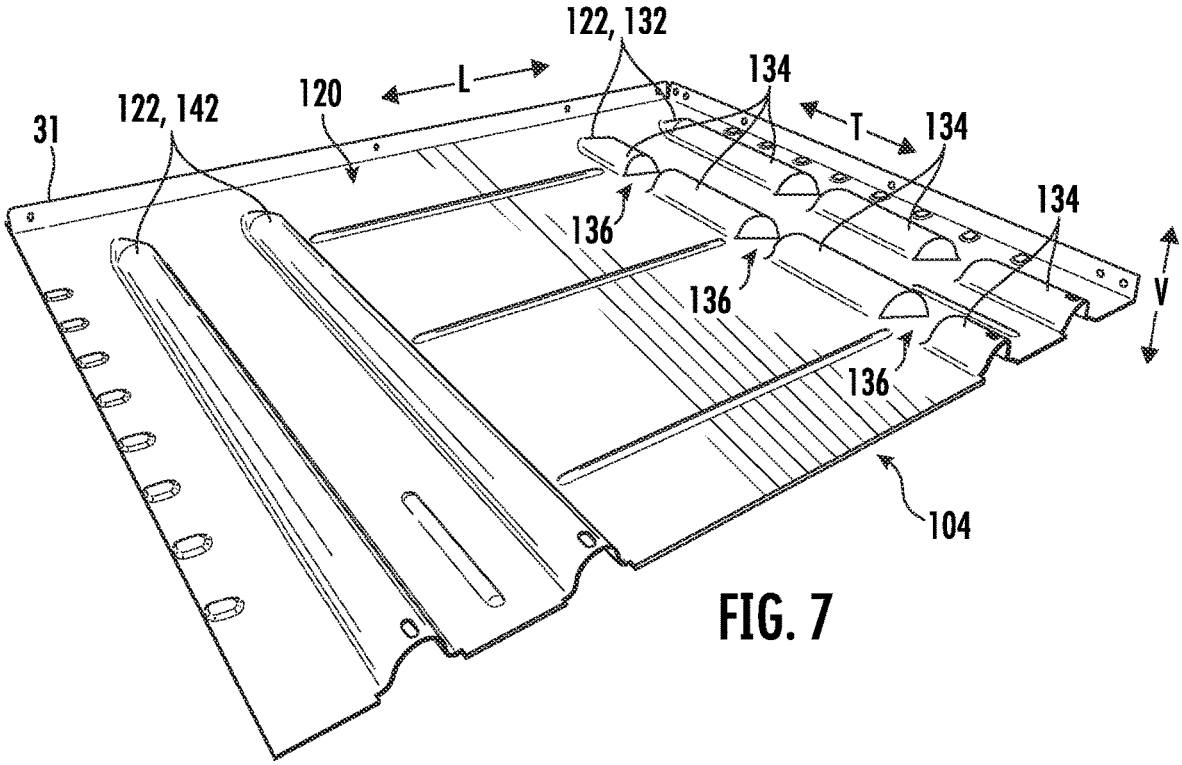
FIG. 7 provides a perspective view of a bottom panel of a cabinet of an oven appliance according to still other exemplary embodiments of the present disclosure.
Figure 8:
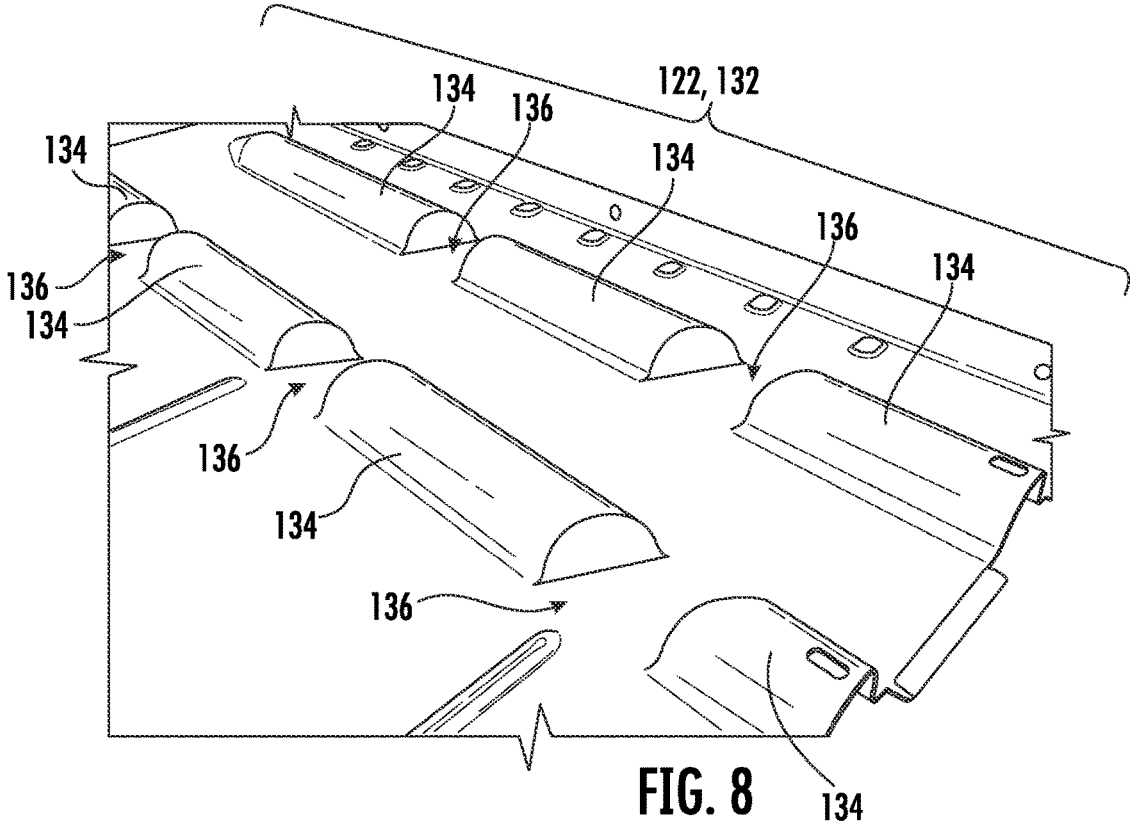
FIG. 8 provides a magnified perspective view of a portion of the exemplary bottom panel of FIG. 7.

As shown in FIG. 6, optional embodiments may further include one or more divider trims 126 that extend above (e.g., at a higher height along the vertical direction V than) the guide ridges 122. For instance, a divider trim 126 may extend vertically from the bottom panel 31 and forward along the transverse direction T from a rear end of the bottom panel 31. In some such embodiments, a divider trim 126 may server to separate parallel portions of the airflow segment. In the illustrated embodiments, the divider trim 126(*s*) are disposed laterally inward from one or more guide ridges 122 (e.g., to further apportion or divide a central flow of air from a flow proximal to the lateral ends of the bottom panel 31).

Returning generally to FIGS. 4 through 8, along with extending along a length of the airflow path 100, the guide ridges 122 may extend toward the cooking chamber 14 (e.g., vertically) from the bottom panel 31. Such guide ridges 122 may be formed directly on the bottom panel 31 (e.g., as a portion thereof). As an example, one or more guide ridges 122 may be raised embossings elevated relative to the rest of internal surface 120. Moreover, such embossings may have an embossed inverse U-shaped channel (e.g., when viewed along the transverse direction T) extending inward toward the cooking chamber 14. Nonetheless, alternative embodiments may have an embossed inverse V-shaped channel or otherwise be shaped in another suitable manner.

Figure 5:
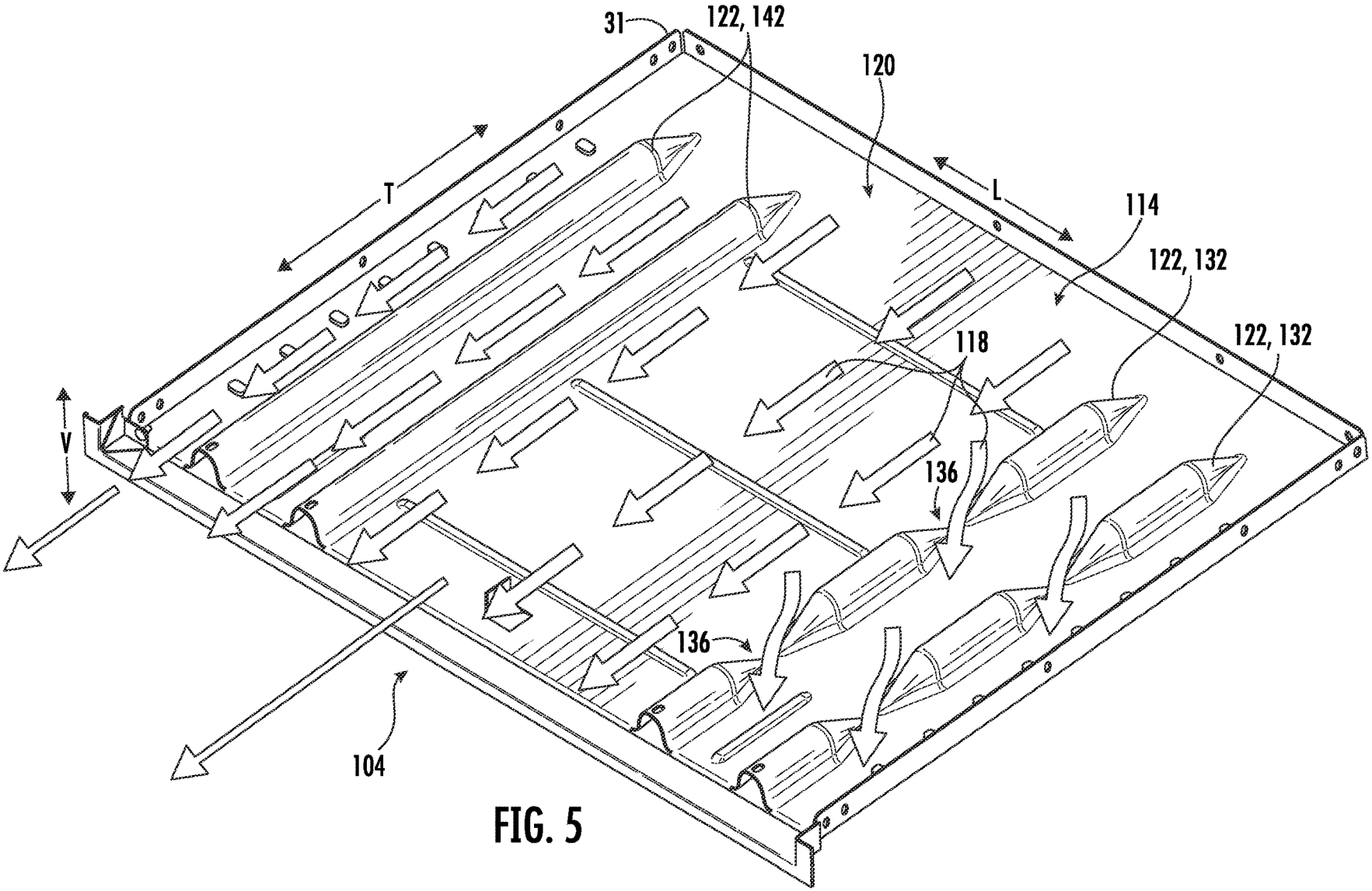
FIG. 5 provides a perspective view the exemplary bottom panel of FIG. 4, wherein the flow of across the bottom panel is illustrated.

In some embodiments, one or more of the guide ridges 122 are formed as a ridge set 132 having a plurality of internal ridges 134. In a ridge set 132, adjacent ridges 134 (e.g., adjacent along the direction of air flow for airflow path 100 or relative to the transverse direction T) may be at least partially spaced apart. Specifically, adjacent ridges 134 may be separated along the airflow path 100 (e.g., along the direction of air flow for airflow path 100), such as along the transverse direction T. Adjacent ridges 134 may further be aligned along the airflow path 100, such that a straight line may extend parallel to the airflow path 100 (or transverse direction T) through adjacent internal ridges 134. In turn, a cross-path gap 136 may be defined between adjacent ridges 134. As shown, the cross-path gap 136 creates an opening (e.g., extending at an angle relative to the airflow path 100, such as along the lateral direction L) through which a portion of air in the airflow path 100 may pass. Thus, additional air may pass, for instance, from a high-flow center segment to an outer low-flow segment, as illustrated by FIG. 5.

Notably, the volume of cooling air (and thus heat transfer effect) is increased to portions of airflow path 100 that would otherwise be omitted or have a reduced flow of air.

Generally, the plurality of internal ridges 134 and cross-path gaps 136 may be formed from any suitable shape. As noted above, the internal ridges 134 may embossed inverse U-shaped channel extending inward toward the cooking chamber 14. In certain embodiments, such as those illustrated in FIGS. 4 through 6, the cross-path gaps 136 may be V-shaped (e.g., as viewed along the lateral direction L) to define an opening perpendicular to the airflow path 100 or transverse direction T. In other embodiments, though, such as those illustrated in FIGS. 7 and 8, the cross-path gaps 136 may be angled relative to the airflow path 100 or transverse direction. For instance, each cross-path gap 136 may extend at a non-parallel, non-orthogonal angle relative to the airflow path 100 or transverse direction T, such that air may pass forward and outward through the cross-path gap 136 (from a high-flow center segment to an outer low-flow segment).

Similar to shape, any suitable number of internal ridges 134 (and thus cross-path gaps 136) may be provided. In the illustrated embodiments, at least three internal ridges 134 are provided to define two discrete cross-path gaps 136 for a corresponding ridge set 132.

In optional embodiments, multiple discrete ridge sets 132 are provided, such as a first ridge set 132 and a second ridge set 132. As shown, each ridge set 132 includes its own plurality of internal ridges 134 defining one or more cross-path gaps 136. Such ridge sets 132 may be spaced apart from each other in a direction distinct from the airflow path 100 (e.g., perpendicular to the airflow path 100 or along the lateral direction L). Multiple ridge sets 132 may be formed or otherwise provided in parallel to each other (e.g., parallel to the airflow path 100 or transverse direction T). Additionally or alternatively, cross-path gaps 136 of separate ridge sets 132 may be parallel to each other (e.g., along the lateral direction L).

In additional or alternative embodiments, one or more continuous ridge 142*s* are included with the guide ridges 122. As shown, the continuous ridge 142 generally extends uninterrupted along its length E and does not define any cross-path gaps. The continuous ridge 142 may be spaced apart from the ridge set 132 in a direction distinct from the airflow path 100 (e.g., perpendicular to the airflow path 100 or along the lateral direction L). The continuous ridge 142 may be formed or otherwise provided in parallel to one or more ridge set 132 (e.g., parallel to the airflow path 100 or transverse direction T). Optionally, the length E of the continuous ridge set 132 may be greater than or equal to the length E of the ridge set 132.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A oven appliance defining a vertical direction, a lateral direction, and a transverse direction, the oven appliance comprising:

a cabinet comprising a plurality of outer panels and defining an airflow path extending through the cabinet;

an insulated cooking chamber disposed within the cabinet, the airflow path being defined between the outer panels and the insulated cooking chamber; and a plurality of internal ridges disposed within the cabinet along the airflow path, each internal ridge of the plurality of internal ridges having a maximum-length edge extending along and parallel to the airflow path and defining a guided segment of the airflow path, the plurality of internal ridges being spaced apart along the airflow path and thereby define a cross-path gap between adjacent ridges of the plurality of internal ridges, wherein the maximum-length edge is an edge wherein no other respective edge on each internal ridge exceeds its length.

2. The oven appliance of claim 1, wherein each internal ridge of the plurality of internal ridges comprises an embossed inverse U-shaped channel extending inward toward the insulated cooking chamber.

3. The oven appliance of claim 1, wherein the plurality of outer panels comprises a top panel, a rear panel, and a bottom panel, and wherein the plurality of internal ridges is disposed between the bottom panel and the insulated cooking chamber.

4. The oven appliance of claim 3, wherein the plurality of internal ridges are formed on the bottom panel.

5. The oven appliance of claim 3, wherein the airflow path comprises a top segment between the top panel and the insulated cooking chamber, a rear segment downstream from the top segment between the rear panel and the insulated cooking chamber, and a bottom segment downstream from the rear segment between the bottom panel and the insulated cooking chamber.

6. The oven appliance of claim 3, further comprising a fan mounted within the cabinet along the airflow path to motivate air therethrough, the fan defining a rotation axis above the insulated cooking chamber.

7. The oven appliance of claim 1, wherein the plurality of internal ridges comprise at least three internal ridges defining a plurality of cross-path gaps.

8. The oven appliance of claim 1, wherein the plurality of internal ridges is a first plurality of ridges forming a first ridge set, wherein the oven appliance further comprises a second ridge set comprising a second plurality of ridges spaced apart along the airflow path and thereby defining a cross-path gap between adjacent ridges of the second plurality of ridges, and wherein the second ridge set is parallel to the first ridge set and spaced apart therefrom along a direction distinct from the airflow path.

9. The oven appliance of claim 1, wherein the plurality of internal ridges is a first plurality of ridges forming a first ridge set having a length along the airflow path, wherein the oven appliance further comprises a continuous ridge having a length along the airflow path greater than or equal to a length of the first ridge set, and wherein the continuous ridge is parallel to the first ridge set and spaced apart therefrom along a direction distinct from the airflow path.

10. The oven appliance of claim 1, further comprising a divider trim extending above the plurality of internal ridges and spaced apart therefrom along a direction distinct from the airflow path, the divider trim separating parallel portions of the airflow path.

11. A oven appliance defining a vertical direction, a lateral direction, and a transverse direction, the oven appliance comprising:

a cabinet comprising a plurality of outer panels and defining an airflow path extending through the cabinet, the plurality of outer panels comprises a top panel, a rear panel, and a bottom panel;

an insulated cooking chamber disposed within the cabinet, the airflow path being defined between the outer panels and the insulated cooking chamber; and a plurality of internal ridges formed on the bottom panel within the cabinet, each internal ridge of the plurality of internal ridges having a maximum-length edge extending along and parallel to the airflow path and defining a guided segment of the airflow path, the plurality of internal ridges being spaced apart along the transverse direction and thereby defining a lateral cross-path gap between adjacent ridges of the plurality of internal ridges, wherein the maximum-length edge is an edge wherein no other respective edge on each internal ridge exceeds its length.

12. The oven appliance of claim 11, wherein each internal ridge of the plurality of internal ridges comprises an embossed inverse U-shaped channel extending inward toward the insulated cooking chamber.

13. The oven appliance of claim 12, wherein the airflow path comprises a top segment between the top panel and the insulated cooking chamber, a rear segment downstream from the top segment between the rear panel and the insulated cooking chamber, and a bottom segment downstream from the rear segment between the bottom panel and the insulated cooking chamber.

14. The oven appliance of claim 12, further comprising a fan mounted within the cabinet along the airflow path to motivate air therethrough, the fan defining a rotation axis above the insulated cooking chamber.

15. The oven appliance of claim 11, wherein the plurality of internal ridges comprise at least three internal ridges defining a plurality of cross-path gaps.

16. The oven appliance of claim 11, wherein the plurality of internal ridges is a first plurality of ridges forming a first ridge set, wherein the oven appliance further comprises a second ridge set comprising a second plurality of ridges spaced apart along the airflow path and thereby defining a cross-path gap between adjacent ridges of the second plurality of ridges, and wherein the second ridge set is parallel to the first ridge set and spaced apart therefrom along a direction distinct from the airflow path.

17. The oven appliance of claim 11, wherein the plurality of internal ridges is a first plurality of ridges forming a first ridge set having a length along the airflow path, wherein the oven appliance further comprises a continuous ridge having a length along the airflow path greater than or equal to a length of the first ridge set, and wherein the continuous ridge is parallel to the first ridge set and spaced apart therefrom along a direction distinct from the airflow path.

18. The oven appliance of claim 11, further comprising a divider trim extending above the plurality of internal ridges and spaced apart therefrom along a direction distinct from the airflow path, the divider trim separating parallel portions of the airflow path.

19. A oven appliance defining a vertical direction, a lateral direction, and a transverse direction, the oven appliance comprising:

a cabinet comprising a plurality of outer panels and defining an airflow path extending through the cabinet, the plurality of outer panels comprising a bottom panel defining a high-flow center segment and an outer low-flow segment;

an insulated cooking chamber disposed within the cabinet, the airflow path being defined between the bottom panel and the insulated cooking chamber; and a plurality of internal ridges disposed within the cabinet at the bottom panel below and outside of the insulated cooking chamber, each internal ridge of the plurality of internal ridges having a maximum-length edge extending along and parallel to the airflow path and defining a guided segment thereof, the plurality of internal ridges being spaced apart along the airflow path and thereby define a cross-path gap between adjacent ridges of the plurality of internal ridges permitting a portion of air in the airflow path from the high-flow center segment to the outer low-flow segment, wherein the maximum-length edge is an edge wherein no other respective edge on each internal ridge exceeds its length.

20. The oven appliance of claim 19, wherein the plurality of internal ridges is a first plurality of ridges forming a first ridge set, wherein the oven appliance further comprises a second ridge set comprising a second plurality of ridges spaced apart along the airflow path and thereby defining a cross-path gap between adjacent ridges of the second plurality of ridges, and wherein the second ridge set is parallel to the first ridge set and spaced apart therefrom along a direction distinct from the airflow path.

* * * * *